United States Patent [19]

Schlegel et al.

[11] 4,407,875

[45] Oct. 4, 1983

[54] TABLEWARE AND DECORATIVE ARTICLES WITH A SURFACE OF SILVER

[75] Inventors: Hans Schlegel, Ulm; Theodor Nowotny; Rolf Mayer, both of Geislingen, all of Fed. Rep. of Germany

[73] Assignee: Wurttembergische Metallwarenfabrik AG, Fed. Rep. of Germany

[21] Appl. No.: 270,563

[22] Filed: Jun. 4, 1981

[30] Foreign Application Priority Data

Jun. 13, 1980 [DE] Fed. Rep. of Germany ..... 3022316

[51] Int. Cl.[3] ..... B65D 5/54; B65D 65/28

[52] U.S. Cl. ..... 428/43; 428/334; 428/461; 428/464; 428/518; 428/542.2; 428/13; 428/516; 427/156; 206/484.2; 206/484; 206/555; 206/605; 206/615

[58] Field of Search ..... 428/43, 334, 461, 464, 428/472, 518, 699, 542.2, 7, 13, 516; 427/156; 206/484, 484.2, 555, 608, 606, 605

[56] References Cited

U.S. PATENT DOCUMENTS

| | | | |
|---|---|---|---|
| 2,021,152 | 11/1935 | Neuhaus | 428/148 |
| 2,109,487 | 3/1938 | Kreidl | 428/472 |
| 2,205,466 | 6/1940 | Caprio et al. | 156/219 |
| 2,214,646 | 9/1940 | Walker | 204/30 |
| 2,278,345 | 3/1942 | Benson | 156/280 |
| 2,579,443 | 12/1951 | Snyder | 428/43 |
| 3,256,315 | 9/1970 | Killian | 206/606 |
| 4,211,326 | 7/1980 | Hein et al. | 428/516 X |
| 4,215,170 | 7/1980 | Oliva | 428/208 X |
| 4,296,179 | 10/1981 | Wardwell | 428/43 X |

*Primary Examiner*—P. Ives

*Attorney, Agent, or Firm*—Arnold, White & Durkee

[57] ABSTRACT

A double coating for the protection of a silver surface article is disclosed. A protective varnish coating, enclosing an inner varnish layer on the silver surface, intimately adheres to and is removable from said inner varnish layer.

9 Claims, 2 Drawing Figures

TABLEWARE AND DECORATIVE ARTICLES WITH A SURFACE OF SILVER

FIELD OF THE INVENTION

This invention relates to tableware and decorative articles in accordance with the preamble of claim 1.

DESCRIPTION OF THE PRIOR ART

The protective varnish coating of such articles serves to render the silver or silver-plated surface easy to care for without impairing the optical appearance. The protective varnish coating prevents the article from discolouring owing to sulphur tarnish and makes it easier to clean the articles by virtue of its water resistance. In known protective varnish layers of this type, however, the water resistance and the resistance to mechanical damage cannot be enhanced at one and the same time. This becomes a nuisance when articles of the aforementioned type are sold in department stores, self-service shops and the like, where they come into direct contact with the public. Packings which are only partially transparent do not permit the customer to view the article from all sides. They are also expensive. Packings which are universally transparent, such as transparent sheet, pouches or bags, do not do justice to the optical qualities of the articles and are thus unsuitable when the articles are exhibited, in particular in shop windows or glass showcases.

SUMMARY OF THE INVENTION

The object of the invention is to provide articles of the type described at the outset with additional protection at least for the time of sale or exhibition without optical impairment.

This object is accomplished in accordance with the invention by the feature in claim 1.

The transparent varnish coating encompasses the silver or silver-plated article on all sides, thus protecting it both from mechanical and other factors from the time the article is manufactured at least until it is sold. Unlike a sheet-like packing, the varnish coating hugs the protective varnish layer so closely that it does not impair the optical appearance of the silver or silver-plated surface at all or does not impair it appreciably. It also permits troublefree cleaning of the articles should they become dusty or marred by fingerprints. The protective varnish layer on the respective article can be returned to its original virgin state by the salesman or customer himself simply by stripping off the varnish coating. Another advantage of the varnish coating is the hermetic seal which prevents the article from being tarnished by electrolytic residues or from developing small corrosion sites, even in an extremely humid and muggy climate.

The varnish coating in a preferred embodiment is based on polyvinyl chloride.

The varnish coating can advantageously contain slightly volatile plasticizers which maintain their elasticity for a long storage period even at temperatures up to 40° C. They exhibit no tendency to diffuse into the protective varnish layer. These plasticizers ensure that the varnish coating will remain elastic at least until the article is sold, thus allowing it to be peeled off very easily.

The varnish coating can be removed simply once it has been separated or broken at one particular location. This can be accomplished, for instance, by scratching or scoring it with a wooden object. In order to facilitate such removal, the varnish coating can also contain one or more tear strips. They save one not only the work of scoring the protective varnish layer, but also indicate clearly to the customer that the varnish coating is an auxiliary covering which is to be removed.

The tear strip can advantageously consist of an absorbent material such as paper or plastic fabric or fleece and is affixed to the article by partially applying it to the varnish coating before this dries. In so doing, the free end of the tear strip advantageously projects beyond the edge of the article. Tear strips of this type can also be imprinted with a trade mark, for example, or with an explanatory note pointing out the double protective layers.

The varnish coating can be applied by immersing the article so that the manufacture of the articles in accordance with the invention is still economical despite the additional protection.

Depending on the shape of the articles and/or if the articles have only a partial silver surface, the varnish coating may also be applied by spraying.

BRIEF DESCRIPTION OF THE DRAWING

One embodiment of an inventive decorative article will now be described in the following with reference to the drawings, in which.

DESCRIPTION OF THE PREFERRED EMBODIMENT

Figure 1:
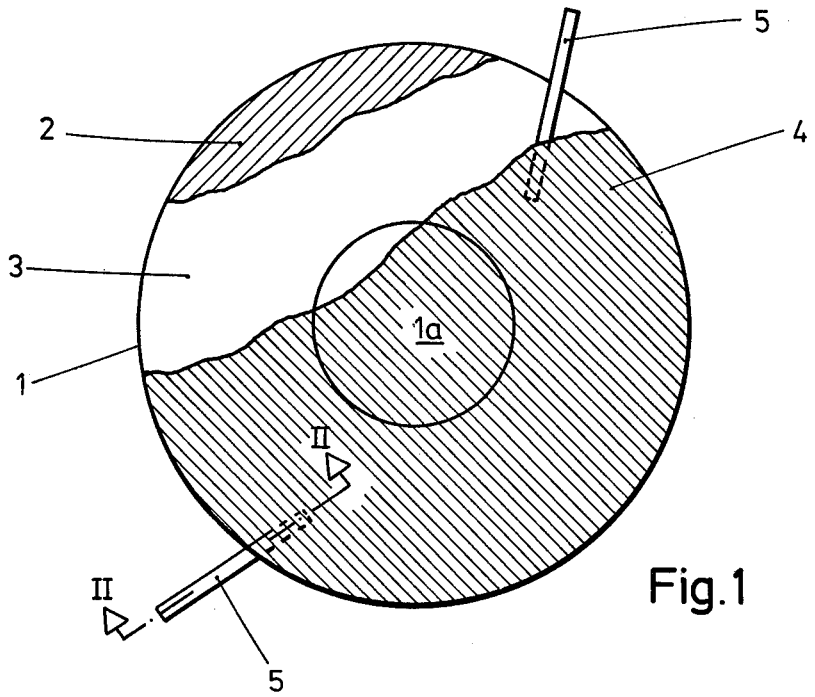
FIG. 1 is a top elevation of a decorative plate with varnish layers partially broken open.
Figure 2:
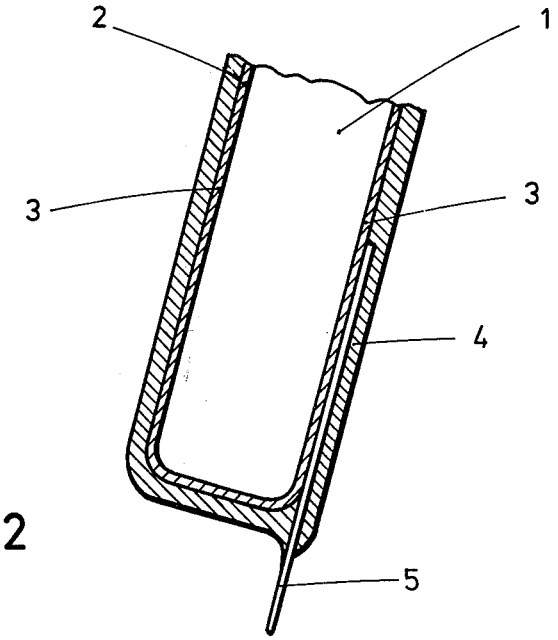
FIG. 2 is a sectional view along line II—II in FIG. 1.

The decorative plate 1 has a circular configuration with a central recess 1*a* also of circular shape. The silver surface 2 is coated with a protective varnish layer of an enamel with a cellulose or synthetic resin base as shown in FIG. 2 which is from 2 to 4 microns thick. In use, it prevents sulphur tarnish from forming on and facilitates the cleaning of the article. Overlying the protective varnish layer 3, the decorative plate 1 is provided with a transparent varnish coating between 30 and 120 microns thick, and preferably between 50 and 80 microns thick. It adheres intimately to the protective varnish layer, although it is not bonded thereto. The optical appearance of the silver surface, however, is in no way impaired by this varnish coating.

the transparent varnish coating preferably consists of

- 30 percent polymer mixture of polyvinylchloride and polyvinyl alcohol as binder
- 60 percent ethyl acetate and xylene as solvent
- 10 percent phthalic acid ester and higher alcohols as plasticizer.

a varnish of this kind is obtainable from

- Dr. Eugen Schaal, Heilbronner Str. 360 7000 Stuttgart 30, W-Germany
- under the designation : "Ambrol-Ziehlack D 212-218"

At a temperature up to 40° C., they retain the elasticity of the varnish coating for long periods of time in such a way that the varnish coating may be removed from the decorative plate 1. In order to make removal easier, the varnish coating 4 is provided with tear strips 5. They are partially embedded between the protective varnish layer 3 and the varnish coating 4 and have a freely projecting segment for gripping.

The varnish coating 4 serves to maintain the decorative plate in perfect condition from the time it is manufactured until it is in the customer's possession without impairing the external appearance. The decorative plate can be viewed from all sides. It can also be exhibited and touched, for instance in self-service shops. Any soiling, tarnishing or minor mechanical damage is taken up by the varnish coating and therefore does not affect the protective varnish layer. The varnish coating can be removed easily by the salesman or by the customer himself before using the decorative plate by merely separating the coating at one or more sites initially by means of the tear strips and thereafter peeling it off the plate in its entirety. This exposes the permanent, durable protective varnish layer which is intended for continuous use. It reveals a brand-new, clean, smooth surface.

The invention is not restricted to the embodiment. The configuration and size of the tableware or decorative article is completely optional within the scope of the invention. The article can be either massive silver or silver-plated. Furthermore, the surface coating in accordance with the invention including the varnish coating may also be applied to only portions of articles which consist of various materials and which feature surfaces only partially silver-plated or partially of silver.

The tear strips make it easier to peel off the varnish coating, although it is also possible to peel it off by scoring it at an initial peeling site using a wooden object.

We claim:

1. A tableware or decorative article with a surface of silver coated with a protective varnish layer of an enamel with a cellulose or synthetic resin base to prevent the article from tarnishing, wherein the article (1) has another transparent varnish coating (4) which adheres intimately to said protective varnish layer without being bonded thereto and which is removable from said protective varnish layer (3).

2. The article according to claim 1, wherein the varnish coating (4) has a polyvinyl chloride base.

3. The article according to claim 2, wherein the varnish coating (4) contains slightly volatile plasticizers which maintain their elasticity for a long storage period even at temperatures up to 40° C. and which exhibit no tendency to diffuse into said protective varnish layer (3).

4. The article according to claim 3, wherein the thickness of the varnish coating (4) ranges between 30 and 130 microns (μm).

5. The article according to at least one of claims 1 to 4, wherein the varnish coating (4) contains one or more tear strips (5).

6. The article according to claim 5, wherein the tear strip (5) is embedded in part between the protective varnish layer (3) and the varnish coating (4).

7. The article according to claim 5, wherein the tear strip (5) consists of an absorbent material such as paper or plastic fabric or fleece and is adapted to be affixed by partially applying it to the varnish coating (4) before the latter has dried.

8. The article according to at least one of claims 1 to 4, wherein the varnish coating (4) is applied by immersion.

9. The article according to at least one of claims 1 to 4, wherein the varnish coating (4) is applied by spraying.

* * * * *

UNITED STATES PATENT OFFICE

CERTIFICATE OF CORRECTION

Patent No. 4,407,875 Dated October 4, 1983

Inventor(s) HANS SCHLEGEL, THEODOR NOWOTNY, and ROLF MAYER

It is certified that error appears in the above-identified patent and that said Letters Patent are hereby corrected as shown below:

Column 4, Line 16, delete "130", insert therefor --120--.

Signed and Sealed this

Twentieth Day of December 1983

[SEAL]

Attest:

GERALD J. MOSSINGHOFF

Attesting Officer

Commissioner of Patents and Trademarks